US011268232B2

(12) United States Patent
Chen et al.

(10) Patent No.: US 11,268,232 B2
(45) Date of Patent: Mar. 8, 2022

(54) APPARATUS AND METHOD FOR PRETREATMENT OF PRINTABLE FABRICS

(71) Applicant: EASTERN TECH LLC, Milford, CT (US)

(72) Inventors: Christopher Chen, Wallingford, CT (US); James DeMarco, Hamden, CT (US); Shawn Liu, Orange, CT (US)

(73) Assignee: EASTERN TECH LLC, Milford, CT (US)

( * ) Notice: Subject to any disclaimer, the term of this patent is extended or adjusted under 35 U.S.C. 154(b) by 302 days.

(21) Appl. No.: 16/598,273

(22) Filed: Oct. 10, 2019

(65) Prior Publication Data

US 2020/0115841 A1 Apr. 16, 2020

Related U.S. Application Data

(60) Provisional application No. 62/744,250, filed on Oct. 11, 2018.

(51) Int. Cl.

| | |
|---|---|
| ***D06F 39/02*** | (2006.01) |
| ***B41M 5/00*** | (2006.01) |
| ***C11D 3/04*** | (2006.01) |
| ***C11D 3/37*** | (2006.01) |
| ***C11D 11/00*** | (2006.01) |
| ***D06F 33/00*** | (2020.01) |

(52) U.S. Cl.

CPC ..... *D06F 39/02* (2013.01); *B41M 5/0011* (2013.01); *B41M 5/0041* (2013.01); *C11D 3/046* (2013.01); *C11D 3/048* (2013.01); *C11D 3/3726* (2013.01); *C11D 3/3749* (2013.01); *C11D 3/3757* (2013.01); *C11D 11/0017* (2013.01); *D06F 33/00* (2013.01)

(58) Field of Classification Search

CPC ..... D06F 39/02

See application file for complete search history.

(56) References Cited

U.S. PATENT DOCUMENTS

| | | | |
|---|---|---|---|
| 4,702,742 | A | 10/1987 | Iwata et al. |
| 4,997,450 | A | 3/1991 | Olson et al. |
| 5,667,533 | A | 9/1997 | Hauser et al. |
| 9,528,215 | B2 | 12/2016 | Tumini et al. |
| 2011/0242189 | A1 | 10/2011 | Okada et al. |
| 2011/0293898 | A1 | 12/2011 | Yatake et al. |
| 2015/0299948 | A1 | 10/2015 | Pan et al. |
| 2015/0375528 | A1 | 12/2015 | Kitagawa et al. |
| 2016/0024709 | A1 | 1/2016 | Walker |
| 2016/0032523 | A1 | 2/2016 | Liu et al. |
| 2017/0058453 | A1 | 3/2017 | Pan et al. |
| 2019/0127909 | A1 | 5/2019 | Chastain et al. |
| 2019/0257030 | A1 | 8/2019 | Chen et al. |

FOREIGN PATENT DOCUMENTS

| | | | |
|---|---|---|---|
| GB | 2458719 | A | 9/2009 |
| JP | 2009249773 | A | 10/2009 |

OTHER PUBLICATIONS

Machine Translation of Japanese Publication No. 2009249773, Publication date Oct. 29, 2009, 3 pages.

Tonello, "Advanced technology for sampling" Oct. 2014, 4 pages.

Tonello, "Operation and Maintenance Instruction Manual: Dyeing Machine for Sampling G1 30", Sep. 1997, 94 pages.

International Search Report issued in Application No. PCT/US2019/055559; International Filing Date Oct. 10, 2019; dated Jan. 20, 2020, 6 pages.

Written Opinion issued in Application No. PCT/US2019/055559; International Filing Date Oct. 10, 2019; dated Jan. 20, 2020, 9 pages.

Firebird Industrial Processing, Industrial Tuble Dryer, 75 Pound (34 Kilogram) Capacity, Model: FBD075X01, Intallation, 2019, 71 pages.

Firebird Industrial Processing, Washer-Extractor with Re-Use Tank, Model: FBW065X01, Hardmount Design 5, Installation/Operation/Maintenance, 2019, 56 pages.

*Primary Examiner* — Jason Y Ko

(74) *Attorney, Agent, or Firm* — Cantor Colburn LLP

(57) ABSTRACT

Disclosed is an apparatus for pretreatment of printable fabrics, comprising a washer/extractor; a control apparatus connected to the washer/extractor to control said washer/extractor; and a source of pretreatment chemicals to be added to the washer/extractor in a controlled manner by the control apparatus. Also disclosed are methods of pretreating fabrics using the disclosed apparatus.

26 Claims, No Drawings

APPARATUS AND METHOD FOR PRETREATMENT OF PRINTABLE FABRICS

CROSS-REFERENCE TO RELATED APPLICATIONS

This application claims the benefit of U.S. Provisional Application Ser. No. 62/744,250 filed Oct. 11, 2018, which is incorporated herewith in its entirety.

BACKGROUND OF THE INVENTION

Presently, Direct-To-Garment (DTG) printing onto fabrics such as cotton or polyester is typically preceded by pretreatment steps that include spraying pretreatment solutions onto the finished garments. Without such pretreatment, DTG printed fabrics may suffer from easily faded graphics after wash or not retain the ink on the fabric altogether. However, conventional pretreatment processes can be labor and machine-intensive in that personnel are required to operate the pretreatment spray machines, properly utilize a heat press/conveyor to dry the fabrics, as well as requiring a detailed knowledge of the proper amounts of pretreatment to apply, for example. These additional steps increase the complexity and cost of producing DTG fabrics. In addition, current spraying pretreatment methods can result in staining of fabrics in the sprayed area, uneven coating of a sprayed area, lack of printability in non-coated or insufficiently coated areas of the fabric, as well as changes in the visual appearance of the fabric due to uneven spraying. There is a need to pretreat fabrics in a manner that is cost-effective, reproducible, efficient, and effective to adhere digital printing to the treated fabrics.

SUMMARY OF THE INVENTION

In one embodiment, the present invention is directed to an apparatus for pretreatment of printable fabrics, comprising a washer/extractor; a control apparatus connected to the washer/extractor to control the washer/extractor; and a source of pretreatment chemicals to be added to the washer/extractor in a controlled manner by the control apparatus.

In another embodiment, the present invention is directed to a process of pretreating fabrics using the above apparatus.

The above described and other features are exemplified by the detailed description.

DETAILED DESCRIPTION OF THE INVENTION

The embodiments for pretreatment of digitally printable fabrics such as cotton and polyester described herein have many advantages over the processes suggested in the past. In these embodiments, the disclosed apparatus permits effective and efficient pretreatment of selected fabrics. The apparatus and method also permits the ink to have good adhesion to the fabric, and excellent vibrancy. In summary, printed fabrics pretreated by these embodiments have a lasting, wash resistant image that does not substantially change the visual appearance of the fabric.

As indicated above, the present application is directed to an apparatus for pretreatment of printable fabrics, comprising a washer/extractor; a control apparatus connected to the washer/extractor to control the washer/extractor; and a source of pretreatment chemicals to be added to the washer/extractor in a controlled manner by said control apparatus.

The term "washer/extractor" as used in the present application refers to generally an industrial washing machine used in, for example, hotels, prisons, schools, and the like, typically for clothing and bedding. An example of one washer/extractor suitable for use in the present invention is the UniMac UW/UY series high performance industrial washer/extractor, the B&C Technologies SI series, and the Girbau HS/RM series.

The washer/extractor of the invention includes a control apparatus, which is preferably a computer and accompanying software that can be programmed by the user to achieve the desired results. In one embodiment, the control apparatus and software can be controlled either by direct inputs on the apparatus itself, or remotely through an infrared, networked wireless, or wired system. Examples of suitable control apparatus and software include Unimac and Unilinc systems for the UniMac washer/extractor; B&C EL-6 for the B&C SI Series, and Girbau Inteli Control for the Girbau HS/RM series.

The control apparatus can control many operational parameters of the washer/extractor, including but not limited to:

Pumps: The pumps can control the volume of pretreatment solution that is added to the washer/extractor and hence the concentration of pretreatment applied to the treated fabrics.

Water Temperature: Water temperature is specific for particular fabrics, for example, hot for pretreating a polyester fabric, but cold for others such as cotton.

Water Level: Water Level controls the volume of water added to the washer/extractor, and hence the concentration of the pretreatment composition.

Agitation: Agitation controls the time the fabrics are agitating in the washer/extractor, as well as the direction of spin.

Extraction Speed and Time: Extraction speed and timing can control the amount of pretreatment retained on the treated fabrics.

The washer/extractor may also include an optional re-use tank used to collect the extracted pretreatment solution. After garments are coated with liquid pretreatment, high speed extraction separates the solution from the garments and is discarded (disposal through drain). The re-use tank is a vessel that is connected to the washer-extactor machine via piping and pumps so that extracted pretreatment solution is stored and available for application to ensuing batches. The re-use system may be programmed via software (ie. Unimac Software, version 7.0 or later), controlled by the user.

The re-use tank and system provides advantages in reducing wasted pretreatment solution. For example, in a typical cycle, the apparatus of the invention requires approximately 20 gallons (200 lbs) of pretreatment product to fully immerse and wet the garments in the washer-extractor system (max capacity 144 shirts). After high-speed extraction, only about 2 lbs-5 lbs of liquid solution is actually coated on the garments (1-2.5%). Without the re-use tank, there would be 97.5-99% waste in the liquid pretreatment (going down the drain), resulting in high expense and inefficiency.

An example of a suitable washer/extractor for use in the present invention is the Tonello G1 HD, G1 70 unit available from Tonello S.r.l., Sarcedo Italy.

The apparatus is used to pretreat various selected fabrics prior to digital printing. Examples of some printable fabrics include cotton, polyester, rayon, and combinations thereof. Suitable printable fabrics that may be used in the apparatus and process of this invention include cotton, polyester, rayon, and combinations thereof. Preferred fabrics include 100% cotton, 100% polyester, 50% cotton 50% polyester, 50% polyester 25% rayon 25% cotton, 90% cotton 10% polyester, and 98% cotton 2% polyester.

The term "cotton fabric" as used in the present specification and claims means any cotton fabric, or any portion thereof, that is capable of being digitally printed, especially by a DTG digital printing process. Such cotton garments include 100% cotton garments as well as cotton blend garments, such as those comprising of 98% cotton and 2% polyester. Other useful cotton garments can incorporate viscose, rayon, nylon and other synthetic and fibers.

Some embodiments of digital printable cotton fabrics used in this way are clothes, particularly t-shirts. Other embodiments of digital printable cotton fabrics include canvas bags, signage, and promotional goods.

The term "polyester fabric" as used in the present specification and claims means any polyester fabric, or any portion thereof, that is capable of being digitally printed, especially by a DTG digital printing process. Such polyester garments include 100% polyester garments as well as polyester blend garments, such as those comprising of 92% polyester and 8% spandex. Other useful polyester garments can incorporate viscose, rayon, nylon and other synthetic and fibers. Further, polyester blend garments can incorporate natural cellulose fibers, such as cotton.

Some embodiments of digital printable polyester fabrics used in this way are clothes, particularly t-shirts. Other embodiments of digital printable polyester fabrics include tablecloths, signage, and promotional goods.

The fabric pretreatment chemicals used in the apparatus of the invention is an aqueous solution of selected amounts of at least three components, namely, at least one multivalent cationic salt; a blocked isocyanate crosslinking agent, and a waterborne resin. The pretreatment solution can also contain selected amounts of other optional ingredients, namely, vinyl polymer, other resins, solvents/penetrants, humectants and finishing agents such as fragrances, surfactants, preservatives, biocides, dyes and rheology modifiers. Preferably, the pretreatment chemicals comprise (A) 5% to 70% by weight of at least one multivalent cationic salt; (B) 0.1% to 5% by weight of a blocked isocyanate crosslinking agent, and (C) 3% to 40% by weight of a waterborne resin, all percentages based on the weight of the aqueous solution;

The at least one multivalent cationic salt can include any salt wherein the multivalent cation comprises one or more of the group of multivalent cations of elements Mg, Ca, Sr, Ba, Sc, Y, La, Ti, Zr, V, Cr, Mn, Fe, Ru, Co, Rh, Ni, Pd, Pt, Cu, Au, Zn, Al, Ga, In, Sb, Bi, Ge, Sn and Pb. "Multivalent" indicates an oxidation state of two or more and, for an element "Z", are typically described as $Z^{2+}$, $Z^{3+}$, $Z^{4+}$ and so forth. For brevity, multivalent cations may be referred to herein as $Z^{x}$. The multivalent cations are substantially soluble in the aqueous pretreatment solution and preferably exist (in solution) in a substantially ionized state so that they are in a form where they are free and available to interact with textile when the textile is exposed to the pretreatment solution. Any suitable divalent salt can be used. Calcium is a particularly useful multivalent cation for many present embodiments.

For many embodiments, the at least one multivalent cationic salt is chosen from the group consisting of calcium nitrate, calcium nitrate hydrate, calcium nitrate tetrahydrate, calcium ammonium nitrate, calcium chloride or other soluble calcium sates, or a combination comprising at least one of the foregoing. Calcium nitrate tetrahydrate is particularly useful because of cost, performance and availability considerations.

For some embodiments, particularly cotton, at least one multivalent cationic salt is preferably 40% to 70% by weight of the aqueous pretreatment solution. Calcium nitrate tetrahydrate can be used in amounts from 47% to 62%, more preferably 50% to 60%, by weight of the aqueous pretreatment solution, based on the weight of the aqueous solution, in some embodiments.

For some embodiments, particularly polyester, at least one multivalent cationic salt is preferably 5% to 35% by weight of the aqueous pretreatment solution. Calcium nitrate tetrahydrate can be used in amounts from 7% to 22%, more preferably 10% to 20%, by weight of the aqueous pretreatment solution, based on the weight of the aqueous solution, in some embodiments.

The term "blocked isocyanate crosslinking agent" as used in the present specification and claims means any blocked isocyanate crosslinking agent that can be used in a digital printing process with polyester fabric. For some embodiments, the isocyanate group in the blocked polyisocyanate crosslinking agent can be a blocked di-polyisocyanate, or a blocked tri-polyisocyanate, and combinations thereof.

For some embodiments, the isocyanate group in the blocked polyisocyanate crosslinking agent can a trifunctional trimethylolpropane (TMP) of Toluene diisocyante (TDI); hexamethylene diisocyanate (HDI), hydrogenated xylylene diisocyanate (H6XDI), isophorone diisocyanate (IPDI), or dicyclohexylmethane diisocyanate (H12MDI), or a combination comprising at least one of the foregoing.

For some embodiments, the blocking agent can be diethyl malonate (DEM), diisopropyl amine (DIPA), 1,2,4-triazol (TRIA), 3,5-dimethylpyrazol (DMP) and butanoneoxime (MEKO).

For some embodiments, the blocked isocyanate crosslinking agent is a blocked aliphatic isocyanate.

Examples of commercial blocked isocyanate crosslinking agent products include Rudolf-Venture Chemical Ruco-Guard XCR, Ruco-Guard TIE or Ruco-Link 3109.

For some embodiments, the amount of the blocked isocyanate crosslinking agent is 0.1% to 5%, preferably, 1% to 4%, by weight, based on the weight of the aqueous solution. The preferred embodiment being 1.5% by weight Ruco-Guard XCR.

The term "waterborne resin" as used in the present specification and claims means any aqueous resin dispersion or emulsion that can be used in a digital printing process with polyester fabric. For some embodiments, the waterborne resin is an acrylic resin or latex or emulsion, a polyurethane resin or emulsion, an acrylic-vinylidene chloride copolymers, a styrene butadiene rubber latex, an acrylic styrene emulsion, a vinyl acrylic emulsion, a vinyl acetate ethylene (VAE) copolymer emulsion or combinations of one or more of the foregoing. The waterborne resin is preferably salt stable and washes well. The use of waterborne resin such as aqueous resin dispersions can improve the wash resistance of printed inks.

For some embodiments, the amount of the waterborne resin is 3% to 40%, preferably 4% to 25%, by weight, based on the weight of the aqueous solution.

In some optional embodiments, a vinyl polymer may be additionally present. The vinyl polymer may be any vinyl polymer product that provides adhesion to the polyester fabric. For some embodiments, the vinyl polymer is poly (vinyl alcohol ethylene); polyvinyl acetate; polyvinyl alcohol polymer; or a combination of one or more the foregoing.

Commercial products that contain vinyl polymers that can be used herein include Elmer's School Glue, Elmer's Glue-all, Elmer's School Glue Gel, Kuraray Exceval HR-3010, Kuraray Exceval RS-2117, Kuraray Exceval RS-1717 or Kuraray Exceval AQ-4104. The amount of the vinyl polymer is 0.1% to 10% by weight, based on the weight of the aqueous solution. In other embodiments, the amount of the vinyl polymer is 0.1% to 5% by weight, based on the weight of the aqueous solution. The preferred embodiment being 6% by weight Elmer's Glue-All.

In some other optional embodiments, the aqueous pretreatment solution further comprises at least one organic solvent/penetrant. In some embodiments, the at least one organic solvent/penetrant is a mixture of propylene glycol methyl ether and dipropylene glycol methyl ether. Other suitable solvent/penetrant can be almost any miscible solvent including ethanol, ethylene glycol, propylene glycol or acetone.

If used, the amount of the propylene glycol methyl ether can be 0.1% to 1% by weight of the pretreatment solution and the amount of the dipropylene glycol methyl ether can be 0.5% to 1.5% by weight of the pretreatment solution.

In some other optional embodiments, wherein the aqueous pretreatment solution further comprises at least one humectant. The humectant can be chosen from propylene glycol, ethylene glycol, polyethylene glycol (various) or derivatives of those compounds. For some embodiments, propylene glycol is the humectant. The presence of the humectant is believed to improve the stain protecting effects of the pretreatment solution.

If used, wherein the amount of the at least one humectant can be from 0.1% to 15% by weight of the pretreatment solution.

In some other optional embodiments, the aqueous pretreatment solution further comprises at least finishing agent. The at least one finishing agent comprises fragrances, surfactants, preservatives, biocides, dyes and rheology modifiers. The addition of fragrances is beneficial in reducing the appearance of a vinegar smell from the acetic acid, such as water-soluble lavender oil and other essential oils.

If used, the amount of finishing agent can be from 0.01% to 1% by weight of the pretreatment solution.

The balance of the solution is water. In one embodiment, the pretreatment chemical composition may be added to the washer/extractor via a pump controlled by the control apparatus.

In an alternative embodiment, the source of the pretreatment chemicals for use in treating polyester is a concentrated pretreatment comprising a mixture of 5 parts to 35 parts by weight of at least one multivalent cationic salt, 0.1 parts to 5 parts by weight a blocked isocyanate crosslinking agent, and 3 parts to 40 parts by weight of a waterborne resin. In another alternative embodiment, the source of pretreatment chemicals for treating cotton is a concentrated pretreatment comprising a mixture of 40 parts to 70 parts by weight of at least one multivalent cationic salt, 0.1 parts to 5 parts by weight a blocked isocyanate crosslinking agent, and 3 parts to 40 parts by weight of a waterborne resin. These concentrates can be prepared beforehand and then diluted with water anywhere, including during operation of the apparatus. The diluted concentrated pretreatment solution can comprised of 1 part by weight pretreatment concentrate to 5 parts by weight water to 1 part by weight pretreatment concentrate to 0.1 parts by weight water. The concentrated pretreatment can be easily shipped and the aqueous pretreatment solution can be prepared on site from the concentrate.

The aqueous pretreatment solution can be easily prepared. This pretreatment solution does not require special mixing steps since there is no reactivity or solubility issues. In one embodiment, the salt is diluted in the water before adding the other ingredients, and then the other ingredients are added slowly with mixing so as to not "shock" to the ingredients. A person having skilled in this art would know how to perform this standard methodology of mixing ingredients.

In some optional embodiments, the fabric can be contacted with an aqueous sodium hydroxide or sodium carbonate solution before the contacting with aqueous pretreatment solution. This contacting can include submerging/dipping the fabric in the solution and then wringing as well as other known fabric/aqueous solution contacting techniques. This can be done manually, or through use of industrial textile extractor. A desirable pickup percentage of the sodium hydroxide or sodium carbonate onto the fabric (i.e., the weight of fabric plus the weight of sodium hydroxide or sodium carbonate solution divided by weight of fabric) can be from 1% to 25% by weight. The percent of the sodium hydroxide or sodium carbonate in the aqueous solution can be in the range from 1% to 10% by weight. The sodium hydroxide or sodium carbonate contacting allows the later applied pretreatment solution to better adhere or bond or attract to the fabric. In some other optional embodiments, a wetting agent may be added to the sodium hydroxide or sodium carbonate solution to keep loose dye suspended during washing, thus preventing backstaining while aiding the removal of excess dye color. Synthrapol™ wetting agent is one example of such wetting agents. After the contacting with the aqueous sodium hydroxide or sodium carbonate solution, some embodiments additionally rinse the fabric with water. Exemplary mechanical means of drying include use of industrial centrifugal or rotary extraction dryers or conveyor dryers.

After the optional contacting with the aqueous sodium hydroxide or sodium carbonate solution (with or without the subsequent water rinsing step), but before the contacting with aqueous pretreatment solution, the fabric is dried to remove the excess water from the fabric, leaving sodium hydroxide or sodium carbonate on the polyester fabric. The drying can be carried out by any conventional means, such by air drying or using a heat source such as conveyor/tunnel dryer, forced air, or heat press.

After the pretreatment solution is prepared, it is contacted to the fabric or a portion thereof using the above described washer/extractor set at appropriate settings for the fabric and desired results. As explained in more detail in the Example that follows, the general steps of the pretreatment include the following:

A. Textiles are loaded into the washer/extractor
B. A cycle is selected
C. The washer/extractor is filled with the pretreatment composition at a selected dilution amount
D. The textiles and pretreatment composition are agitated together for a set amount of time
E. The washer/extractor spins at a target RPM and time in order to achieve the desired extraction level
F. The extracted, pretreated textiles are then dried or subsequently processed.

An optional "prep-step" may be also included prior to the cycle selection step B above, wherein the textiles are first contacted with a pumped, diluted sodium hydroxide or carbonate solution as described above.

Following pretreatment, the fabrics may be further processed and subjected to digital printing using known techniques.

EXAMPLE

The following is an example of one embodiment of the above apparatus and process.

1. A quantity of shirts is loaded into the washer-extractor
   i. In a 45 lb variant of the washer, e.g., a box/case of 72 shirts, such as Bella+Canvas 3001, Black/Large, 100% Ringspun Cotton Shirts
2. A cycle is selected
   a. Ex: "Black Bella Canvas" cycle
      i. The cycle pumps in a fixed amount of water & pretreatment, creating a desired dilution.
         With the Black Bella Canvas cycle, 5 gallons of pretreatment is added into approximately 10 gallons of water
   b. The textiles and pretreatment composition are agitated together for a set amount of time
      i. With the Black Bella Canvas cycle, 3 minutes of agitation is used at normal wash RPMs
      ii. A drain cycle, followed by a high RPM extraction cycle removes excess pretreatment for a target wet pickup per shirt
      iii. With the Black Bella Canvas cycle, "High" extract speed for 5 minutes is used
      iv. Optionally, the drained/extracted pretreat can be collected through a special pump system into a re-use tank for future reuse
3. The pretreated shirts are dried
   a. Ex: "High heat, 1% humidity" cycle
      i. The dryer dries the clothes at the highest heat (190° F.) until the humidity in the dryer falls to the programmed 1% humidity
4. Shirts are now DTG enabled (printable)
   a. Optionally, the shirts may be pressed with a heat press for 5-10 seconds before printing with a digital printer The present disclosure is further illustrated by the following Embodiments:

Embodiment 1

An apparatus for pretreatment of printable fabrics, comprising:

a washer/extractor; and a control apparatus connected to said washer/extractor to control said washer/extractor;

a source of pretreatment chemicals to be added to said washer/extractor in a controlled manner by said control apparatus.

Embodiment 2

The apparatus of embodiment 1, wherein said washer/extractor is an industrial washer.

Embodiment 3

The apparatus of embodiment 1, wherein said control apparatus comprises a computer and software.

Embodiment 4

The apparatus of embodiment 3, wherein said computer is controlled through an infrared, networked wireless, or wired system.

Embodiment 5

The apparatus of embodiment 1, wherein said control apparatus controls the quantity of said pretreatment chemicals to be added to said washer/extractor.

Embodiment 6

The apparatus of embodiment 1, wherein said control apparatus controls the temperature and quantity of water added to said washer/extractor.

Embodiment 7

The apparatus of embodiment 1, wherein said control apparatus controls agitation of the washer/extractor.

Embodiment 8

The apparatus of embodiment 1, wherein said control apparatus controls the extraction speed of said washer/extractor.

Embodiment 9

The apparatus of embodiment 1, further comprising a re-use tank in fluid communication with said washer/extractor.

Embodiment 10

The apparatus of embodiment 1, wherein said pretreatment chemicals comprise (A) 5% to 70% by weight of at least one multivalent cationic salt; (B) 0.1% to 5% by weight of a blocked isocyanate crosslinking agent, and (C) 3% to 40% by weight of a waterborne resin, all percentages based on the weight of the aqueous solution;

Embodiment 11

The apparatus of embodiment 10, wherein said at least one multivalent cationic salt has a cation that comprises a multivalent cation of element Mg, Ca, Sr, Ba, Sc, Y, La, Ti, Zr, V, Cr, Mn, Fe, Ru, Co, Rh, Ni, Pd, Pt, Cu, Au, Zn, Al, Ga, In, Sb, Bi, Ge, Sn and Pb, or a combination of at least one of the foregoing.

Embodiment 12

The apparatus of embodiment 11, wherein said cation is calcium.

Embodiment 13

The apparatus of embodiment 12, wherein the at least one multivalent cationic salt is selected from the group consisting of calcium nitrate, calcium nitrate hydrate, calcium nitrate tetrahydrate, calcium ammonium nitrate, calcium chloride, or a combination comprising at least one of the foregoing.

Embodiment 14

The apparatus of embodiment 10, wherein the amount of the at least one multivalent cationic salt is 7% to 22% by weight, based on the weight of the aqueous solution.

Embodiment 15

The apparatus of embodiment 10, wherein the amount of the at least one multivalent cationic salt is 47% to 62% by weight, based on the weight of the aqueous solution.

Embodiment 16

The apparatus of embodiment 10, wherein the isocyanate group in the blocked isocyanate crosslinking agent is blocked di-polyisocyanate, blocked tri-polyisocyanate, and combinations thereof.

Embodiment 17

The apparatus of embodiment 16, wherein the isocyanate group in the blocked isocyanate crosslinking agent is a trifunctional trimethylolpropane (TMP) of toluene diisocyanate (TDI); hexamethylene diisocyanate (HDI), hydrogenated xylylene diisocyanate ($H_6$XDI), isophorone diisocyanate (IPDI), or dicyclohexylmethane diisocyanate ($H_{12}$MDI), or a combination comprising at least one of the foregoing.

Embodiment 18

The apparatus of embodiment 10, wherein the blocking agent is diethyl malonate (DEM), diisopropyl amine (DIPA), 1,2,4-triazol (TRIA), 3,5-dimethylpyrazol (DMP) and butanoneoxime (MEKO).

Embodiment 19

The apparatus of embodiment 10, wherein the blocked isocyanate crosslinking agent is a blocked aliphatic isocyanate.

Embodiment 20

The apparatus of embodiment 10, wherein the amount of the blocked isocyanate crosslinking agent is from 1% to 4% by weight, based on the weight of the aqueous solution.

Embodiment 21

The apparatus of embodiment 10, wherein the waterborne resin is an acrylic resin or emulsion, a polyurethane resin or emulsion, an acrylic-vinylidene chloride copolymers, a styrene butadiene rubber latex, an acrylic styrene emulsion, a vinyl acrylic emulsion, a vinyl acetate ethylene (VAE) copolymer emulsion or combinations of one or more of the foregoing.

Embodiment 22

The apparatus of embodiment 10, wherein the amount of the waterborne resin is 4% to 25% by weight, based on the weight of the aqueous solution.

Embodiment 23

The apparatus of embodiment 1, wherein said source of pretreatment chemicals is a concentrated pretreatment comprising a mixture of 5 parts to 35 parts by weight of at least one multivalent cationic salt, 0.1 parts to 5 parts by weight a blocked isocyanate crosslinking agent, and 3 parts to 40 parts by weight of a waterborne resin.

Embodiment 24

The apparatus of embodiment 1, wherein said source of pretreatment chemicals is a concentrated pretreatment comprising a mixture of 40 parts to 70 parts by weight of at least one multivalent cationic salt, 0.1 parts to 5 parts by weight a blocked isocyanate crosslinking agent, and 3 parts to 40 parts by weight of a waterborne resin.

Embodiment 25

The apparatus of embodiment 1, wherein said printable fabrics comprise cotton, polyester, rayon, and combinations thereof.

Embodiment 26

The apparatus of embodiment 25, wherein said printable fabrics are selected from the group consisting of 100% cotton, 100% polyester, 50% cotton 50% polyester, 50% polyester 25% rayon 25% cotton, 90% cotton 10% polyester, and 98% cotton 2% polyester.

Embodiment 27

A process of pretreating fabrics using the apparatus of embodiment 1.

The compositions, methods, and articles can alternatively comprise, consist of, or consist essentially of, any appropriate materials, steps, or components herein disclosed. The compositions, methods, and articles can additionally, or alternatively, be formulated so as to be devoid, or substantially free, of any materials (or species), steps, or components, that are otherwise not necessary to the achievement of the function or objectives of the compositions, methods, and articles.

All ranges disclosed herein are inclusive of the endpoints, and the endpoints are independently combinable with each other (e.g., ranges of "up to 25 wt. %, or, more specifically, 5 wt. % to 20 wt. %", is inclusive of the endpoints and all intermediate values of the ranges of "5 wt. % to 25 wt. %," etc.). "Combinations" is inclusive of blends, mixtures, alloys, reaction products, and the like. The terms "first," "second," and the like, do not denote any order, quantity, or importance, but rather are used to distinguish one element from another. The terms "a" and "an" and "the" do not denote a limitation of quantity, and are to be construed to cover both the singular and the plural, unless otherwise indicated herein or clearly contradicted by context. "Or" means "and/or" unless clearly stated otherwise. Reference throughout the specification to "some embodiments", "an embodiment", and so forth, means that a particular element described in connection with the embodiment is included in at least one embodiment described herein, and may or may not be present in other embodiments. In addition, it is to be understood that the described elements may be combined in any suitable manner in the various embodiments.

Unless defined otherwise, technical and scientific terms used herein have the same meaning as is commonly understood by one of skill in the art to which this application belongs. All cited patents, patent applications, and other references are incorporated herein by reference in their entirety. However, if a term in the present application contradicts or conflicts with a term in the incorporated reference, the term from the present application takes precedence over the conflicting term from the incorporated reference.

Compounds are described using standard nomenclature. For example, any position not substituted by any indicated group is understood to have its valency filled by a bond as indicated, or a hydrogen atom. A dash ("-") that is not between two letters or symbols is used to indicate a point of attachment for a substituent. For example, —CHO is attached through carbon of the carbonyl group.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. An apparatus for pretreatment of printable fabrics, comprising:

a washer/extractor;

a control apparatus connected to said washer/extractor to control said washer/extractor; and a source of pretreatment chemicals to be added to said washer/extractor in a controlled manner by said control apparatus;

wherein said pretreatment chemicals comprise (A) 5% to 70% by weight of at least one multivalent cationic salt; (B) 0.1% to 5% by weight of a blocked isocyanate crosslinking agent, and (C) 3% to 40% by weight of a waterborne resin, all percentages based on the weight of the aqueous solution.

2. The apparatus of claim 1, wherein said washer/extractor is an industrial washer.

3. The apparatus of claim 1, wherein said control apparatus comprises a computer and software.

4. The apparatus of claim 3, wherein said computer is controlled through an infrared, networked wireless, or wired system.

5. The apparatus of claim 1, wherein said control apparatus controls the quantity of said pretreatment chemicals to be added to said washer/extractor.

6. The apparatus of claim 1, wherein said control apparatus controls the temperature and quantity of water added to said washer/extractor.

7. The apparatus of claim 1, wherein said control apparatus controls agitation of the washer/extractor.

8. The apparatus of claim 1, wherein said control apparatus controls the extraction speed of said washer/extractor.

9. The apparatus of claim 1, further comprising a re-use tank in fluid communication with said washer/extractor.

10. The apparatus of claim 1, wherein said at least one multivalent cationic salt has a cation that comprises a multivalent cation of element Mg, Ca, Sr, Ba, Sc, Y, La, Ti, Zr, V, Cr, Mn, Fe, Ru, Co, Rh, Ni, Pd, Pt, Cu, Au, Zn, Al, Ga, In, Sb, Bi, Ge, Sn and Pb, or a combination of at least one of the foregoing.

11. The apparatus of claim 10, wherein said cation is calcium.

12. The apparatus of claim 11, wherein the at least one multivalent cationic salt is selected from the group consisting of calcium nitrate, calcium nitrate hydrate, calcium nitrate tetrahydrate, calcium ammonium nitrate, calcium chloride, or a combination comprising at least one of the foregoing.

13. The apparatus of claim 1, wherein the amount of the at least one multivalent cationic salt is 7% to 22% by weight, based on the weight of the aqueous solution.

14. The apparatus of claim 1, wherein the amount of the at least one multivalent cationic salt is 47% to 62% by weight, based on the weight of the aqueous solution.

15. The apparatus of claim 1, wherein the isocyanate group in the blocked isocyanate crosslinking agent is blocked di-polyisocyanate, blocked tri-polyisocyanate, and combinations thereof.

16. The apparatus of claim 15, wherein the isocyanate group in the blocked isocyanate crosslinking agent is a trifunctional trimethylolpropane (TMP) of toluene diisocyanate (TDI); hexamethylene diisocyanate (HDI), hydrogenated xylylene diisocyanate ($H_6$XDI), isophorone diisocyanate (IPDI), or dicyclohexylmethane diisocyanate ($H_{12}$MDI), or a combination comprising at least one of the foregoing.

17. The apparatus of claim 1, wherein the blocking agent is diethyl malonate (DEM), diisopropyl amine (DIPA), 1,2,4-triazol (TRIA), 3,5-dimethylpyrazol (DMP) and butanoneoxime (MEKO).

18. The apparatus of claim 1, wherein the blocked isocyanate crosslinking agent is a blocked aliphatic isocyanate.

19. The apparatus of claim 1, wherein the amount of the blocked isocyanate crosslinking agent is from 1% to 4% by weight, based on the weight of the aqueous solution.

20. The apparatus of claim 1, wherein the waterborne resin is an acrylic resin or emulsion, a polyurethane resin or emulsion, an acrylic-vinylidene chloride copolymers, a styrene butadiene rubber latex, an acrylic styrene emulsion, a vinyl acrylic emulsion, a vinyl acetate ethylene (VAE) copolymer emulsion or combinations of one or more of the foregoing.

21. The apparatus of claim 1, wherein the amount of the waterborne resin is 4% to 25% by weight, based on the weight of the aqueous solution.

22. The apparatus of claim 1, wherein said source of pretreatment chemicals is a concentrated pretreatment comprising a mixture of 5 parts to 35 parts by weight of at least one multivalent cationic salt, 0.1 parts to 5 parts by weight a blocked isocyanate crosslinking agent, and 3 parts to 40 parts by weight of a waterborne resin.

23. The apparatus of claim 1, wherein said source of pretreatment chemicals is a concentrated pretreatment comprising a mixture of 40 parts to 70 parts by weight of at least one multivalent cationic salt, 0.1 parts to 5 parts by weight a blocked isocyanate crosslinking agent, and 3 parts to 40 parts by weight of a waterborne resin.

24. The apparatus of claim 1, wherein said printable fabrics comprise cotton, polyester, rayon, and combinations thereof.

25. The apparatus of claim 23, wherein said printable fabrics are selected from the group consisting of 100% cotton, 100% polyester, 50% cotton 50% polyester, 50% polyester 25% rayon 25% cotton, 90% cotton 10% polyester, and 98% cotton 2% polyester.

26. A process of pretreating fabrics using the apparatus of claim 1.

* * * * *